US005370219A

United States Patent [19]

Violett, Jr.

[11] Patent Number: 5,370,219

[45] Date of Patent: Dec. 6, 1994

[54] CONTAINERS FOR THE STORAGE AND TRANSPORTATION OF STICKS OF GUM

[76] Inventor: David L. Violett, Jr., 724 N. 23rd St., St. Joseph, Mo. 64506

[21] Appl. No.: 177,525

[22] Filed: Jan. 4, 1994

[51] Int. Cl.[5] ..... F21V 33/00; B65D 85/60; B65D 85/62

[52] U.S. Cl. ..... 206/38; 206/37; 206/37.8; 206/800; 206/216; 362/154; 362/253; 362/116

[58] Field of Search ..... 206/216, 38, 37, 39, 206/39.3, 39.7, 800, 453, 455, 362, 362.1, 362.2, 38.1, 37.8; 362/154, 253, 116

[56] References Cited

U.S. PATENT DOCUMENTS

| | | | |
|---|---|---|---|
| 2,719,626 | 10/1955 | Lermer | 206/362.2 |
| 2,988,209 | 6/1961 | Parrilla | 206/800 X |
| 4,049,165 | 9/1977 | Goldhaft | 206/38 X |
| 4,305,118 | 12/1981 | Paquette | 362/253 X |
| 4,866,952 | 9/1989 | Hight et al. | 206/37 X |
| 4,978,003 | 12/1990 | Foster | 206/362 X |
| 4,991,717 | 2/1991 | May et al. | 206/455 |
| 5,107,987 | 4/1992 | Palazzolo et al. | 206/209.1 |

*Primary Examiner*—Paul T. Sewell
*Assistant Examiner*—Jacob K. Ackun, Jr.
*Attorney, Agent, or Firm*—Michael J. Colitz, Jr.

[57] ABSTRACT

A container for sticks of gum comprising a container having four rectangular side walls, and a bottom wall in a rectangular shape coupling the side walls in a rectangular configuration with a central axis and with an open top in a configuration essentially the same as that of the bottom wall, the side walls and bottom wall forming a chamber for the receipt of a pack of sticks of gum, the open top being recessed to form exterior bearing surfaces formed in the side walls on their exterior surfaces both parallel and transverse with respect to the axis and further comprising a closure cap having four rectangular side walls and a top wall in a rectangular shape coupling the side walls in a rectangular axis with a central axis and with an open bottom, the open bottom being recessed to form exterior bearing surfaces both parallel and transverse to the axis and positionable in contact with the bearing surfaces of the container when in a coupled closed orientation.

3 Claims, 4 Drawing Sheets

FIG. 1
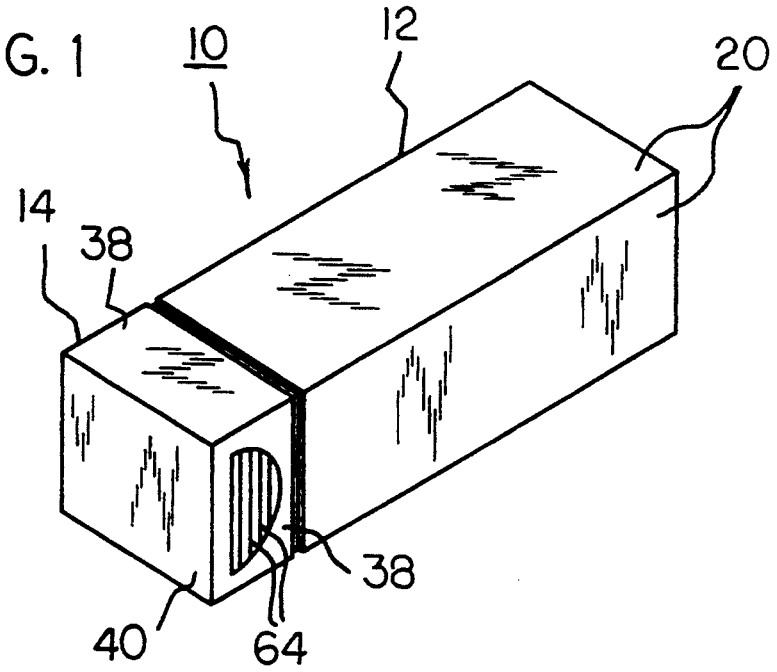
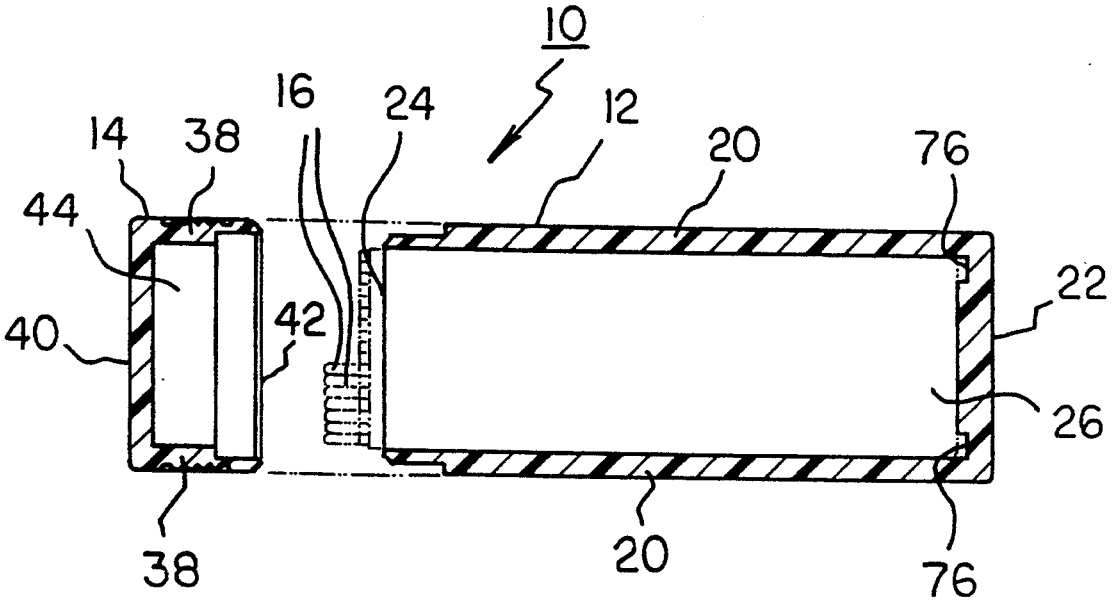
FIG. 2

CONTAINERS FOR THE STORAGE AND TRANSPORTATION OF STICKS OF GUM

BACKGROUND OF THE INVENTION

1. Field of the Invention

The present invention relates to containers for the storage and transportation of sticks of gum and more particularly pertains to storing and transporting sticks of gum to abate damage to the gum and dissemination of scents.

2. Description of the Prior Art

The use of containers for various articles is known in the prior art. More specifically, containers for various articles heretofore devised and utilized for the purpose of precluding damage to the articles within the container are known to consist basically of familiar, expected, and obvious structural configurations, notwithstanding the myriad of designs encompassed by the crowded prior art which has been developed for the fulfillment of countless objectives and requirements.

The prior art discloses a large number of containers for various articles. By way of example, U.S. Pat. No. 3,606,133 to Meyers discloses a reclosable carton construction.

U.S. Pat. No. 4,192,420 to Worrell, Sr. discloses a flexible and pliable moisture-impervious package.

U.S. Pat. No. 5,029,712 to O'Brien discloses a reclosure stick gum package.

U.S. Pat. No. 4,613,046 to Kuchenbecker discloses a reclosable package and carton blank.

Lastly, U.S. Pat. No. 5,125,211 to O'Brien discloses a reclosable stick gum package.

In this respect, containers for the storage and transportation of sticks of gum according to the present invention substantially depart from the conventional concepts and designs of the prior art, and in doing so provide an apparatus primarily developed for the purpose of storing and transporting sticks of gum to abate damage to the gum and dissemination of scents.

Therefore, it can be appreciated that there exists a continuing need for new and improved containers for the storage and transportation of sticks of gum which can be used for storing and transporting sticks of gum to abate damage to the gum and dissemination of scents. In this regard, the present invention substantially fulfills this need.

SUMMARY OF THE INVENTION

In view of the foregoing disadvantages inherent in the known types of containers for various articles now present in the prior art, the present invention provides improved containers for the storage and transportation of sticks of gum. As such, the general purpose of the present invention, which will be described subsequently in greater detail, is to provide new and improved containers for the storage and transportation of sticks of gum and methods which have all the advantages of the prior art and none of the disadvantages.

To attain this, the present invention essentially comprises a new and improved container for the storage and transportation of sticks of gum comprising, in combination, a container having four rectangular side walls, and a bottom wall in a rectangular shape coupling the side walls in a rectangular configuration with a central axis and with an open top in a configuration essentially the same as that of the bottom wall, the side walls and bottom wall forming a chamber for the receipt of a pack of sticks of gum with the ends of the sticks extending outwardly from the top, the open top being recessed to form exterior bearing surfaces formed in the side walls on their exterior surfaces both parallel and transverse with respect to the axis. Further provided is a closure cap having four rectangular side walls and a top wall in a rectangular shape coupling the side walls in a rectangular axis with a central axis and with an open bottom shaped in a configuration corresponding to that of the bottom wall of the container, the open bottom being recessed to form exterior bearing surfaces both parallel and transverse to the axis and positionable in contact with the bearing surfaces of the container when in a coupled closed orientation, the outermost edges of the container and cap being chamfered to facilitate the coupling of the cap and the container. Finger gripping ridges are formed into the exterior surface of opposed side walls of the cap to facilitate coupling and uncoupling of the cap with the container. The cap and side walls are formed of a similar plastic material. A recess is formed within the bearing surface of the container around the periphery thereof and an associated locking lip extending outwardly from the bearing surface of the cap is positionable in the recess for the locking of the cap with respect to the container. A slot is formed into the interior surface of one of the side walls in the interior of the container for breaking of a vacuum when a gum pack is inserted and removed. A peripheral cut out is formed in the interior of the container at the area of joining between the bottom wall and the side walls. A flashlight is coupled with respect to the end of the container opposite the open end, the flashlight having a transparent block with a recess, the block being removably secured to the bottom wall of the container, a supplemental recess formed in the end of the container adjacent the block, the supplemental recess including a bulb and a reflecting parabola with an associated battery and switch exposed for use by the operator. Lastly, a ring is coupled to the end of the cap opposite the open end, the ring having an openable segment for the receipt and removal of a key from the ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved containers for the storage and transportation of sticks of gum which have all the advantages of the prior art containers for various articles and none of the disadvantages.

It is another object of the present invention to provide new and improved containers for the storage and transportation of sticks of gum which may be easily and efficiently manufactured and marketed.

It is a further object of the present invention to provide new and improved containers for the storage and transportation of sticks of gum which are of a durable and reliable construction.

An even further object of the present invention is to provide new and improved containers for the storage and transportation of sticks of gum which are susceptible of a low cost of manufacture with regard to both materials and labor, and which accordingly are then susceptible of low prices of sale to the consuming public, thereby making such containers for the storage and transportation of sticks of gum economically available to the buying public.

Still yet another object of the present invention is to provide new and improved containers for the storage and transportation of sticks of gum which provide in the apparatuses and methods of the prior art some of the advantages thereof, while simultaneously overcoming some of the disadvantages normally associated therewith.

Even still another object of the present invention is to store and transport sticks of gum to abate damage to the gum and dissemination of scents.

Lastly, it is an object of the present invention to provide a new and improved container for sticks of gum comprising a container having four rectangular side walls, and a bottom wall in a rectangular shape coupling the side walls in a rectangular configuration with a central axis and with an open top in a configuration essentially the same as that of the bottom wall, the side walls and bottom wall forming a chamber for the receipt of a pack of sticks of gum with the ends of the sticks extending outwardly from the top, the open top being recessed to form exterior bearing surfaces formed in the side walls on their exterior surfaces both parallel and transverse with respect to the axis and further comprising a closure cap having four rectangular side walls and a top wall in a rectangular shape coupling the side walls in a rectangular axis with a central axis and with an open bottom shaped in a configuration corresponding to that of the bottom wall of the container, the open bottom being recessed to form exterior bearing surfaces both parallel and transverse to the axis and positionable in contact with the bearing surfaces of the container when in a coupled closed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the containers for the storage and transportation of sticks of gum constructed in accordance with the principles of the present invention.

FIG. 2 is a cross-sectional view taken along the longitudinal center line of the device shown in FIG. 1.

The same reference numerals refer to the same parts throughout the various Figures.

DESCRIPTION OF THE PREFERRED EMBODIMENT

Figure 3:
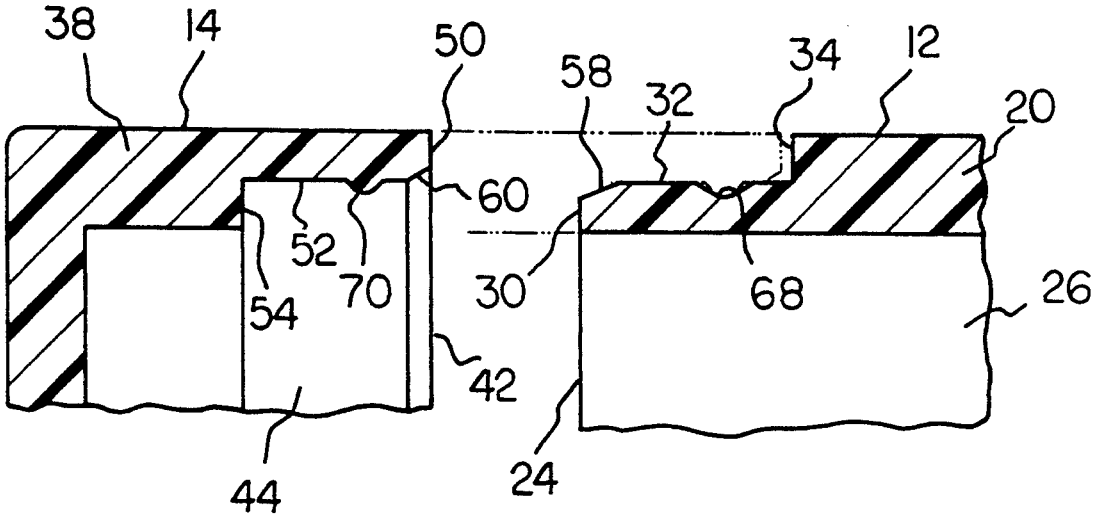
FIG. 3 is an enlarged sectional view illustrating the ends of the container and cap.
Figure 4:
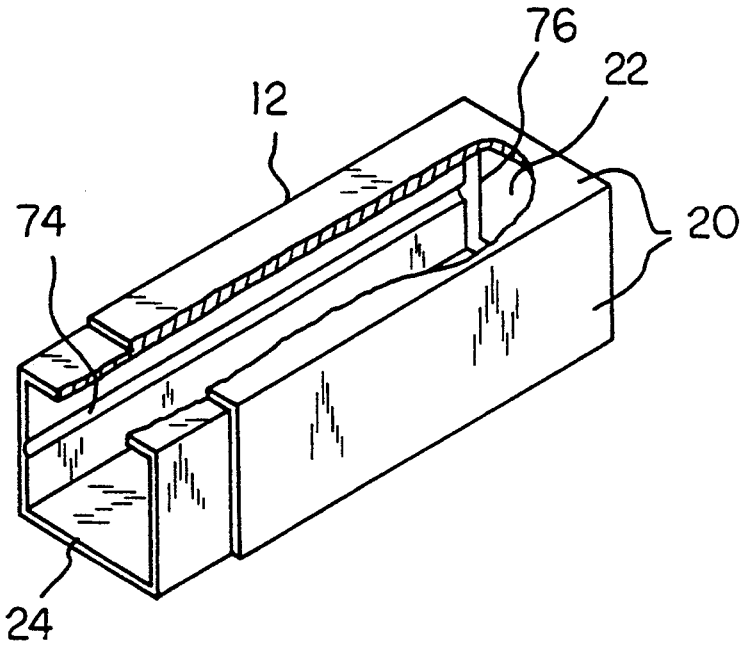
FIG. 4 is a perspective view partly in section of the invention.

With reference now to the drawings, and in particular to FIG. 1 thereof, the preferred embodiment of the new and improved container for the storage and transportation of sticks of gum embodying the principles and concepts of the present invention and generally designated by the reference numeral 10 will be described.

Specifically, it will be noted with reference to FIGS. 1 through 4 that the present invention is a gum container device 10. In its broadest of terms, the device includes a container 12 and a cap 14 for the storage and transportation of sticks 16 of gum.

More specifically, the container 12 has four rectangular side walls 20. It also has a rectangular bottom wall 22 in a rectangular configuration. The end wall is coupled at its periphery to the side walls to form a rectangular configuration with an open top 24. The top is in a rectangular configuration essentially the same as that of the bottom wall 22. Together, the side walls and bottom wall form a chamber 26 with a central axis for the receipt of a pack of sticks 16 of gum with the ends of the sticks 16 extending outwardly from the open top. Note FIG. 2.

The open top is formed with a recess to provide exterior bearing surfaces 30, 32, and 34 in the side walls on their exterior surfaces. The bearing surface 32 is parallel with the axis while bearing surfaces 30 and 34 are transverse thereto. Note FIG. 3.

A closure cap 14 is next provided. The cad has side walls 38 and a top wall 40 with an open bottom 42. The bottom 42 is of a rectangular configuration similar to that of the bottom wall 22 of the container 12. The periphery of the top wall 40 couples the side walls 38 of the cap 14 and forms a chamber 44 with a central axis coextensive with the axis of the container 12.

The interior surface of the cap adjacent to the open end is formed with a recess which provides bearing surfaces 50, 52 and 54. Such bearing surfaces are positionable in contact with the bearing surfaces 30, 32 and 34 of the container 12 when in the closed orientation. The bearing surface 52 is parallel with the axis while bearing surfaces 50 and 54 are transverse thereto.

The outermost edges of the cap 14 and container 12 are curved with chamfers 58 and 60 at an angle. This facilitates placement of the cap 14 over the container 12.

Finger gripping ridges 64 are formed into the exterior surface of opposed side walls 38 of the cap 14 wherein each finger gripping ridge is parallely aligned with the top wall 40 of the cap. Such ridges 64 function to facilitate the placement and removal of the cap 14 with respect to the container 12.

The cap 14 and side walls 38 and 40 as well as the container 21 and its walls 20 and 22 are preferably formed of a similar material. The preferred material is a rigid plastic.

A recess 68 is formed within the bearing surface 32 of the container 12 around the periphery thereof. Cooperably associated therewith is a locking lip 70 extending outwardly from the bearing surface 52 of the cap 14. The lip 70 is positionable in the recess 68 for the locking of the cap 14 with respect to the container 12.

A slot 74 is formed into the interior surface of one of the side walls 20 in the interior of the container 12 and linearly extended from the open top to a location near the bottom wall. Note FIG. 4. The slot functions for breaking of a vacuum when a gum pack is inserted and removed with respect to the container. A peripheral cut out 76 is also formed in the interior of the container 12. Such cut out 76 is at the area of joining between the bottom wall 22 and the side walls 20 and perpendicularly intersected with the slot.

Figure 5:
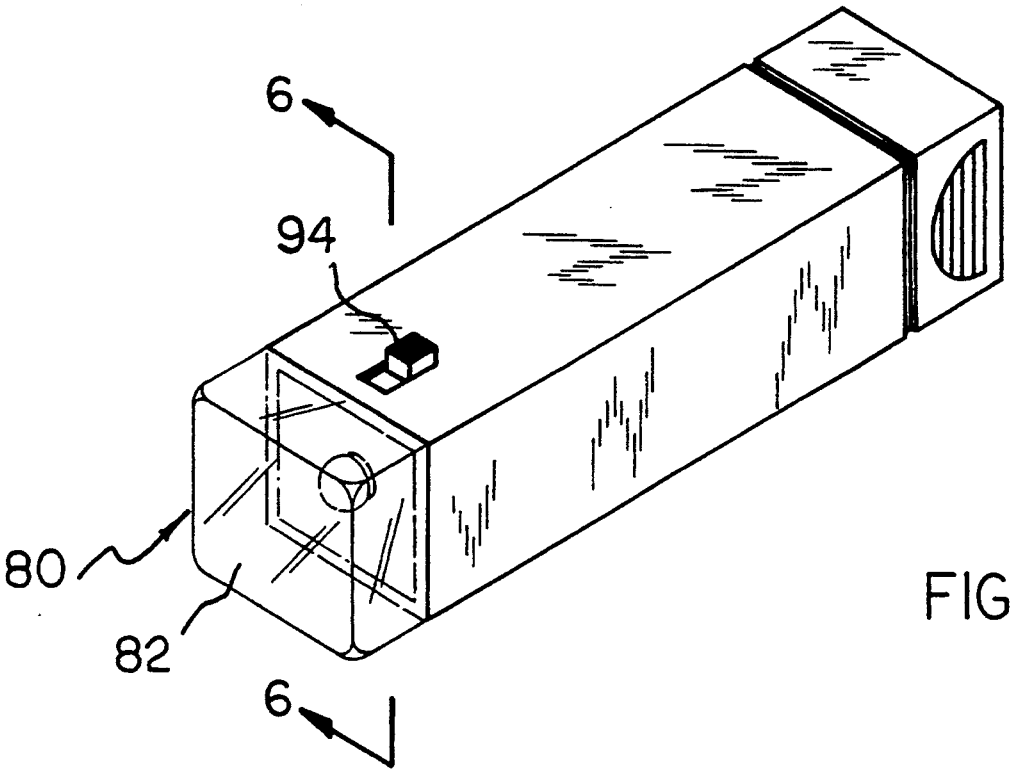
FIG. 5 is a perspective view of the invention with a flashlight formed into the end of the container.
Figure 6:
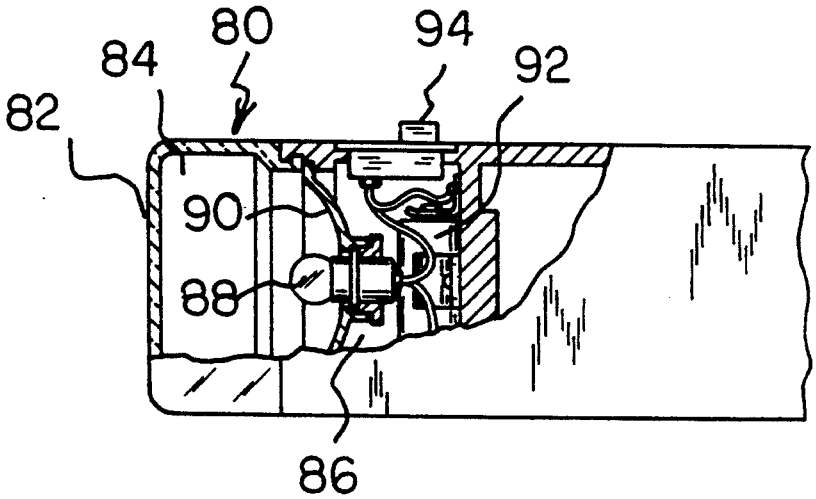
FIG. 6 is a cross-sectional view taken along line 6—6 of FIG. 5.
Figure 7:
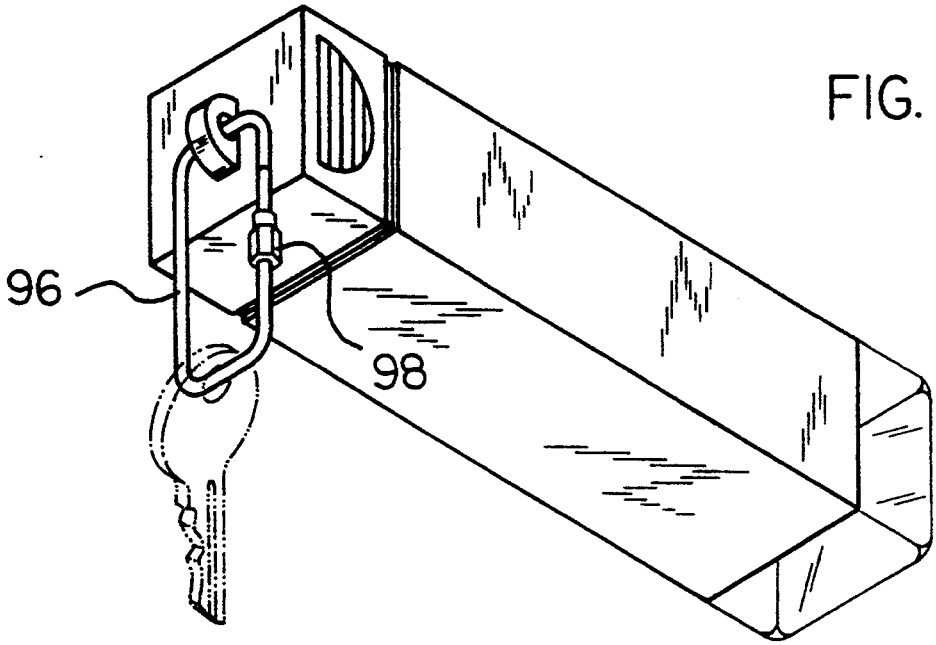
FIG. 7 is a perspective view of the invention with a key ring coupled thereto.
Figure 8:
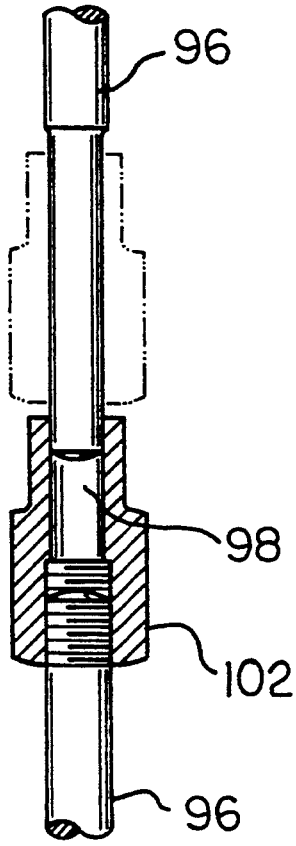
FIG. 8 is a cross-sectional view taken along line 8—8 of FIG. 7.

A flashlight 80 is formed into the end of the container 12 opposite the open top 24. Note FIGS. 5 and 6. The flashlight has a transparent block 82 with a recess 84. The block is removably secured to the end of the container 12 with a supplemental recess 86 formed in the adjacent end of the container. The supplemental recess 86 includes a bulb 88 and a parabolic reflector 90 with an associated battery 92 and switch 94 exposed for use by the operator to allow turning the flash light off and on.

Lastly, a ring 96 is provided. Such ring 96 is formed in a loop to couple to the end of the cap 14 at the end opposite the open bottom 42. The ring functions for the receipt of a key or keys. The ring 96 has an openable segment 98 for the receipt and removal of the key or keys from the ring 96. Opening and closing of the segment is through a shiftable collar 102 axially movable by rotation. Such rotation rotates the collar 102 and its threads with respect to the ring and its threads to open and close the segment 98 of the ring 96.

There are many people that derive enjoyment from chewing gum. It has proven to be beneficial for improved dental hygiene, by removing food particles that can lead to a buildup of plaque which can lead to gum disease and caries. For active people, it can be difficult to carry a package of gum without having it become all stuck together or squashed in a pocket or purse. Once this happens, it is often very difficult to remove the wrapper, and the gum is often just discarded.

Another possibility is that when it is carried in a woman's purse, it can become flavored by the cosmetics and perfume that is often carried there. This too makes the gum unusable.

The present invention provides a means for preventing these unwanted happenings. It protects and store the gum in a safe and durable container that prevents the gum from becoming damp from perspiration, or acquiring unwanted flavors from cosmetics. The present invention is a molded plastic case that is rectangular in shape. It has a removable cover that snaps securely onto the container and forms a seal to prevent moisture and odors from contaminating the gum. It maintains the individual stacks of gum in a neat and consumable condition. The present invention can be produced to store the popular seven or seventeen stick packs of gum. It fits neatly into a pocket or purse, and is always readily available to provide a fresh pleasing stick of gum.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved container for the storage and transportation of sticks of gum comprising, in combination:

a container having four rectangular side walls, and a bottom wall in a rectangular shape coupling the side walls in a rectangular configuration with a central axis and with an open top in a configuration essentially the same as that of the bottom wall, the side walls and bottom wall forming a chamber for the receipt of a pack of sticks of gum with the ends of the sticks extending outwardly from the top, the open top being recessed to form exterior bearing surfaces formed in the side walls on their exterior surfaces both parallel and transverse with respect to the axis;

a closure cap having four rectangular side walls and a top wall in a rectangular shape coupling the side walls in a rectangular axis with a central axis and with an open bottom shaped in a configuration corresponding to that of the bottom wall of the container, the open bottom being recessed to form interior bearing surfaces both parallel and transverse to the axis and positionable in contact with the bearing surfaces of the container when in a coupled closed orientation, the outermost edges of the container and cap being chamfered to facilitate the coupling of the cap and the container;

finger gripping ridges formed into the exterior surface of opposed side walls of the cap to facilitate coupling and uncoupling of the cap with the container;

the cap and the side walls being formed of a similar plastic material;

a recess formed within the bearing surface of the container around the periphery thereof and an associated locking lip extending outwardly from the bearing surface of the cap positionable in the recess for the locking of the cap with respect to the container;

a slot formed into the interior surface of one of the side walls in the interior of the container for breaking of a vacuum when a gum pack is inserted and removed;

a peripheral cut out formed in the interior of the container at the area of joining between the bottom wall and the side walls;

a flashlight coupled with respect to the end of the container opposite the open top, the flashlight having a transparent block with a recess, the block being removably, secured to the bottom wall of the container, a supplemental recess formed in the end of the container adjacent to the block, the supplemental recess including a bulb and a reflecting parabola with an associated battery switch exposed for use by the operator; and a ring coupled to the end of the cap opposite the open bottom, the ring having an openable segment for the receipt and removal of a key from the ring.

2. A container for sticks of gum comprising:

a container having four rectangular side walls, and a bottom wall in a rectangular shape coupling the side walls in a rectangular configuration with a central axis and with an open top in a configuration essentially the same as that of the bottom wall, the side walls and bottom wall forming a chamber for the receipt of a pack of sticks of gum with the ends of the sticks extending outwardly from the top, the open top being recessed to form exterior bearing surfaces formed in the side walls on their exterior surfaces both parallel and transverse with respect to the axis;

a closure cap having four rectangular side walls and a top wall in a rectangular shape coupling the side walls in a rectangular axis with a central axis and with an open bottom shaped in a configuration corresponding to that of the bottom wall of the container, the open bottom being recessed to form interior bearing surfaces both parallel and transverse to the axis and positionable in contact with the bearing surfaces of the container when in a coupled closed orientation, the outermost edges of the container and cap being chamfered to facilitate the coupling of the cap and the container;

finger gripping ridges formed into the exterior surface of opposed side walls of the cap to facilitate coupling and uncoupling of the cap with the container wherein each finger gripping ridge is parallely aligned with the top wall of the cap;

the cap and the side walls being formed of a similar plastic material;

a recess formed within the bearing surface of the container around the periphery thereof and an associated locking lip extending outwardly from the bearing surface of the cap positionable in the recess for the locking of the cap with respect to the container;

a slot formed into the interior surface of one of the side walls in the interior of the container and linearly extended from the open top to a location near the bottom wall for breaking of a vacuum when a gum pack is inserted and removed; and a peripheral cut out formed in the interior of the container at the area of joining between the bottom wall and the side walls and perpendicularly intersected with the slot.

3. The container as set forth in claim 2 and further including:

a ring coupled to the end of the cap opposite the open bottom, the ring having an openable segment for the receipt and removal of a key from the ring.

* * * * *